US009227448B2

(12) United States Patent
Chen et al.

(10) Patent No.: US 9,227,448 B2
(45) Date of Patent: Jan. 5, 2016

(54) DETERMINING SURVIVAL STATE OF PRINT HEAD

(71) Applicant: International Business Machines Corporation, Armonk, NY (US)

(72) Inventors: Xuan Chen, Beijing (CN); Chang Rui Ren, Beijing (CN); Fei Liu, Beijing (CN); Qin Hua Wang, Beijing (CN)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 14/669,707

(22) Filed: Mar. 26, 2015

(65) Prior Publication Data

US 2015/0273923 A1 Oct. 1, 2015

(30) Foreign Application Priority Data

Mar. 28, 2014 (CN) ..... 2014 1 0123853

(51) Int. Cl.
*B41J 29/393* (2006.01)

(52) U.S. Cl.
CPC ..... *B41J 29/393* (2013.01)

(58) Field of Classification Search
CPC .... B41J 29/393; B41J 2/17546; B41J 2/0458; B41J 2/0451; B41J 2/04541; B41J 2/2135; B41J 2/2139; B41J 2/2142; B41J 2/16579; B41J 2/16517; B41J 2002/16502
USPC ..... 347/5, 19
See application file for complete search history.

(56) References Cited

U.S. PATENT DOCUMENTS

| | | | | |
|---|---|---|---|---|
| 5,530,461 | A | 6/1996 | Sakuma | |
| 6,967,733 | B1 | 11/2005 | Minowa | |
| 7,986,887 | B2 * | 7/2011 | Suda | 399/10 |
| 2006/0002753 | A1 | 1/2006 | Hunsberger, Jr. | |
| 2013/0257979 | A1 * | 10/2013 | Adachi | 347/33 |

* cited by examiner

*Primary Examiner* — Alessandro Amari
*Assistant Examiner* — Jeremy Delozier
(74) *Attorney, Agent, or Firm* — Scully, Scott, Murphy & Presser, P.C.; Jeff Tang, Esq.

(57) ABSTRACT

A solution for determining survival state of a print head. In one aspect, the cleaning behavior of a print head can be used for reflecting health status of the print head, so survival state of a print head can be determined according to cleaning behavior of the print head. Specifically, there is provided a method for determining survival state of a print head, comprising: obtaining cleaning behavior data and cumulative printing amount upon failure occurrence of print head(s) of reference printer(s) as well as cleaning behavior of a print head of a current printer; obtaining printing amount of the current printer; determining survival state of the print head of the current printer according to cleaning behavior data and cumulative printing amount upon failure occurrence of the print head(s) of the reference printer(s) as well as cleaning behavior data and printing amount of the current printer.

10 Claims, 6 Drawing Sheets

| Equipment ID | Print Head | |
|---|---|---|
| Eq1101 | 15% | Red |
| Eq1102 | 70% | Green |
| Eq1103 | 34% | Yellow |
| Eq1104 | 45% | Yellow |
| Eq1105 | 53% | Yellow |
| Eq1106 | 24% | Red |
| Eq1107 | 2% | Red |
| Eq1108 | 30% | Red |
| Eq1109 | 76% | Green |
| Eq1110 | 94% | Green |

DETERMINING SURVIVAL STATE OF PRINT HEAD

CROSS-REFERENCE TO RELATED APPLICATIONS

This application is based on and claims the benefit of priority from commonly-owned Chinese Patent Application 201410123853.4, filed on Mar. 28, 2014.

FIELD

The present invention relates to measurement of a print head, and more specifically, to a method and system for determining a survival state of a print head.

BACKGROUND

Inkjet printers are widely used in various fields, such as advertising, export centers, image processing systems, press, photographic studio, apparel design, etc. These business applications typically impose high requirements on inkjet printers, including demanding inkjet printers to have continuous, downtime-free service capability. A print head is the most expensive but the most fragile component in a printer. In order to ensure the printer's continuous service capability, it is necessary to ensure that the print head, the core component in the printer, can provide continuous service or can be updated in time upon failure. The most common problem confronted with print heads is head clogging, for example ink drying due to long time non-usage. The most straightforward approach in the prior art is to use the uniform lifecycle to calculate lifetimes of different print heads. However, since service conditions of various printers (even different printers of the same model) vary, lifetimes of different print heads also vary considerably. Therefore, survival states of all print heads cannot be predicted using the uniform lifecycle.

SUMMARY

Inventors of the present invention learn that cleaning behavior of print heads includes cleans and wipes, which are two basic methods for cleaning printers. On the one hand, upon each power on/off, most printers will automatically launch a cleaning program. On the other hand, if any extent of printer clogging occurs, then a user can alleviate and eliminate clogging by cleaning and wiping. Both methods have significant costs. That is, cleans will consume ink, and in particular ink consumption for large-volume cleaning is considerable; a wiper has certain lifetime and needs to be replaced after a given count, which is also significant post-sale costs. Both methods will damage print heads, i.e., cleans will damage crystal oscillator and wipers will damage the surface of print heads. In fact, the user is unwilling to perform cleans and wipes, unless printer clogging occurs. Thus, cleaning behavior of a print head (including at least one of: cleaning actions and wiping actions) can be used for reflecting health status of the print head. Therefore, inventors of the present invention propose a solution for detecting survival state of a print head according to cleaning behavior.

According to one aspect of the present invention, there is provided a method for determining a survival state of a print head, comprising: A. obtaining cleaning behavior data and a cumulative printing amount upon failure occurrence of print head(s) of reference printer(s), as well as cleaning behavior of a print head of a current printer; B. obtaining a printing amount of the current printer; C. determining the survival state of the print head of the current printer according to the cleaning behavior data and the cumulative printing amount upon failure occurrence of the print head(s) of the reference printer(s), as well as the cleaning behavior data and the printing amount of the current printer.

According to another aspect of the present invention, there is provided a system for determining a survival state of a print head, comprising: a first obtaining module configured to obtain cleaning behavior data and a cumulative printing amount upon failure occurrence of print head(s) of reference printer(s) as well as cleaning behavior of a print head of a current printer; a second obtaining module configured to obtain a printing amount of the current printer; and a determining module configured to determine the survival state of the print head of the current printer according to the cleaning behavior data and the cumulative printing amount upon failure occurrence of the print head(s) of the reference printer(s), as well as the cleaning behavior data and the printing amount of the current printer.

According to at least one embodiment of the present invention, it is possible to achieve pertinent, effective detection of survival state of print heads.

BRIEF DESCRIPTION OF THE SEVERAL VIEWS OF THE DRAWINGS

Through the more detailed description of some embodiments of the present disclosure in the accompanying drawings, the above and other objects, features and advantages of the present disclosure will become more apparent, wherein the same reference generally refers to the same components in the embodiments of the present disclosure.

DETAILED DESCRIPTION

Some preferable embodiments will be described in more detail with reference to the accompanying drawings, in which the preferable embodiments of the present disclosure have been illustrated. However, the present disclosure can be implemented in various manners, and thus should not be construed to be limited to the embodiments disclosed herein. On the contrary, those embodiments are provided for the thorough and complete understanding of the present disclosure, and completely conveying the scope of the present disclosure to those skilled in the art.

Figure 1:
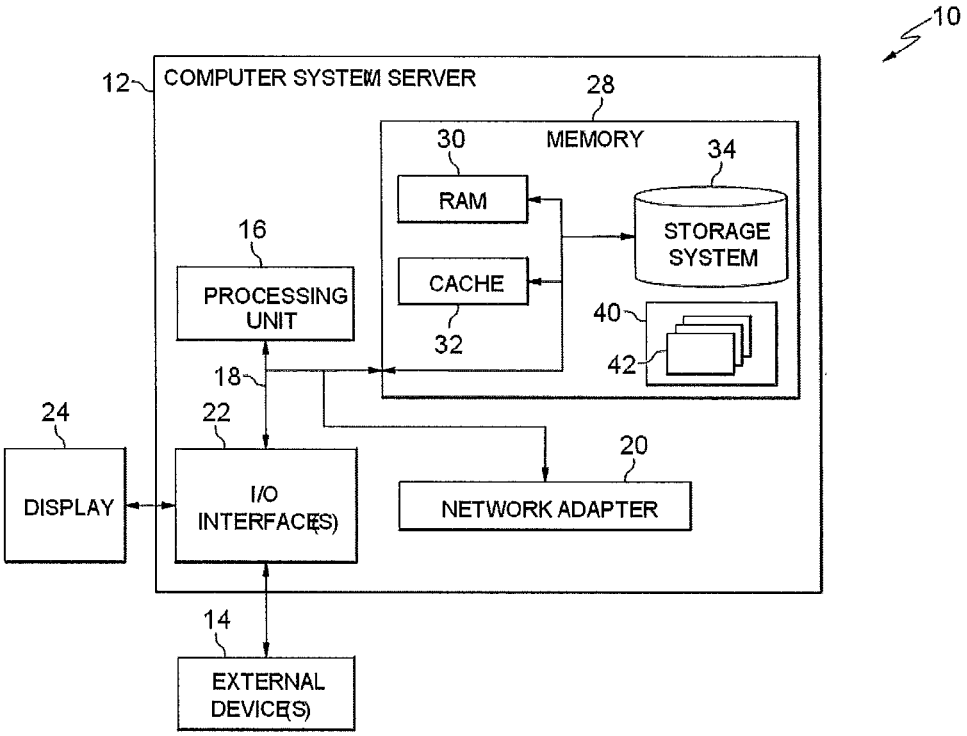
FIG. 1 shows an exemplary computer system/server 12 which is applicable to implement the embodiments of the present invention.

Referring now to FIG. 1, in which an exemplary computer system/server 12 which is applicable to implement the embodiments of the present invention is shown. Computer system/server 12 is only illustrative and is not intended to suggest any limitation as to the scope of use or functionality of embodiments of the invention described herein.

As shown in FIG. 1, computer system/server 12 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 2:
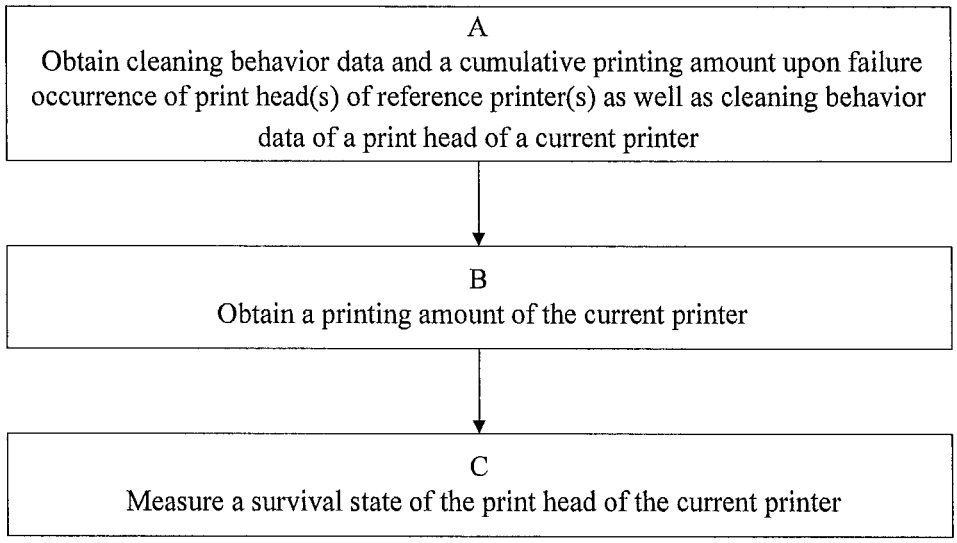
FIG. 2 shows a flowchart of a print head determining method according to one embodiment of the present invention.

FIG. 2 shows a flowchart of a method for determining survival state of a print head according to one embodiment of the present invention. The method for determining survival state of a print head comprises: A obtaining cleaning behavior data and a cumulative printing amount upon failure occurrence of print head(s) of reference printer(s), as well as cleaning behavior data of a print head of a current printer; B obtaining a printing amount of the current printer; and C determining the survival state of the print head of the current printer according to the cleaning behavior data and the cumulative printing amount upon failure occurrence of the print head(s) of the reference printer(s) as well as the cleaning behavior data and the printing amount of the current printer. Detailed illustration is presented below to embodiments of the steps A to C.

First of all, illustration is presented below to a principle of at least one embodiment of the present invention. Inventors of the present invention find that cleaning behavior towards a print head has a close relationship (this relationship will be illustrated in more detail in the description of FIGS. 3A to 3E) with a survival state of the print head, i.e., cleaning behavior towards a print head determines the lifetime of the print head to some extent. Therefore, the inventors of the present invention creatively propose a technical solution for determining a survival state of a print head by using cleaning behavior towards the print head as a measurement index, wherein cleaning behavior data and a cumulative printing amount upon a failure occurrence of print head(s) of reference printer(s) can provide a reference index to reflect the impact of cleaning behavior on the lifetime of the print head(s) of the reference printer(s). The inventors of the present invention further find that lifetimes of various print heads vary considerably. Therefore, it is difficult to use one reference index to reflect lifetimes of all print heads. Therefore, cleaning behavior towards a current printer should be taken into consideration so as to determine the impact of cleaning behavior on the lifetime of the print head of the current printer and further learn the survival state of the current printer under current printing amount. It is worth noting that the present invention may be applicable to an inkjet printer or other printers, so long as cleaning behavior towards a print head of such printers will exert impact on the survival state of the print head.

Figure 3A:
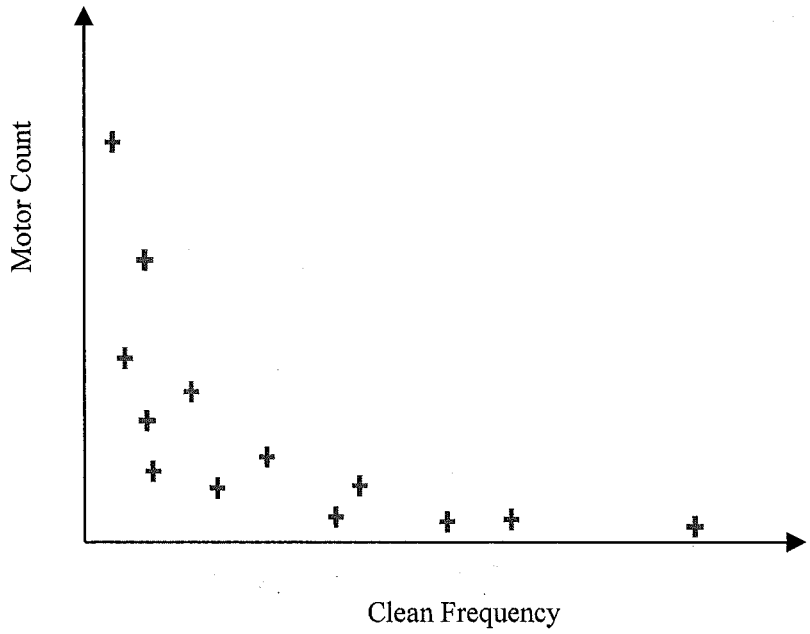
FIG. 3A shows a schematic view of a relationship between clean frequency and motor count according to one embodiment of the present invention.

With reference to FIGS. 3A to 3E, illustration is presented below to a relationship between cleaning behavior towards a print head and the survival state of the print head. FIG. 3A shows a schematic view of a relationship between a clean frequency and a motor count according to one embodiment of the present invention. The horizontal axis represents the clean frequency of print head(s) of reference printer(s), and the vertical axis represents the cumulative motor count upon a failure occurrence of the print head(s) of the reference printer(s). As seen from experiment data in this figure, the higher the clean frequency, the less the motor count upon a failure occurrence; that is, the more frequent cleans, the more liable to failures the print head. Thereby, cleaning behavior is one of factors leading to lifetime loss of print heads.

Figure 3B:
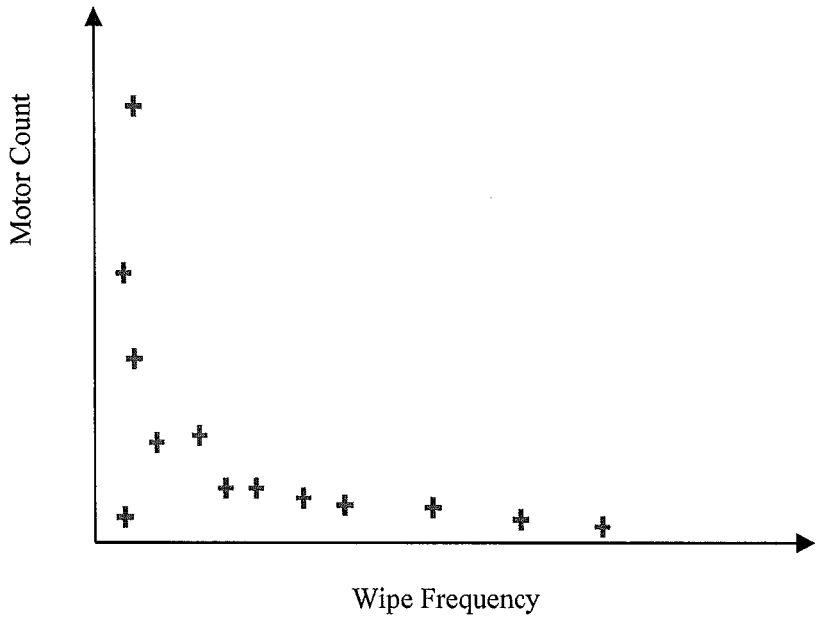
FIG. 3B shows a schematic view of a relationship between wipe frequency and motor count according to one embodiment of the present invention.

FIG. 3B shows a schematic view of a relationship between a wipe frequency and the motor count according to one embodiment of the present invention. The horizontal axis represents the wipe frequency of print head(s) of reference printer(s), and the vertical axis represents the cumulative motor count upon a failure occurrence of the print head(s) of the reference printer(s). As seen from experiment data in this figure, the higher the wipe frequency, the less the motor count upon a failure occurrence; that is, the more frequent wipes, the more liable to failures the print head. Thereby, wiping behavior is one of factors leading to lifetime loss of print heads.

Figure 3C:
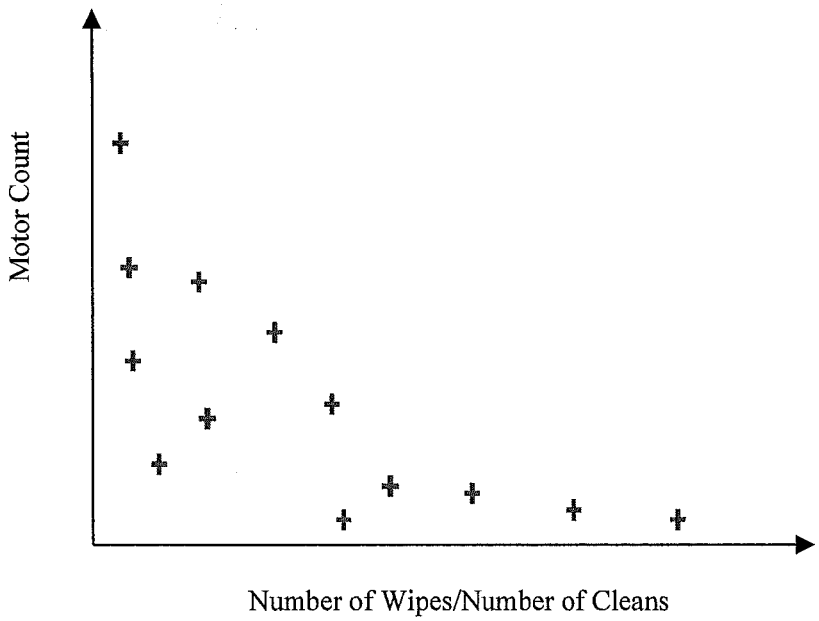
FIG. 3C shows a schematic view of a relationship between a ratio of wipes to cleans and motor count according to one embodiment of the present invention.

FIG. 3C shows a schematic view of a relationship between a ratio of the number of wipes to that of cleans and the motor count according to one embodiment of the present invention. The horizontal axis represents the ratio of the number of wipes to that of cleans (equivalent to a ratio of wipe frequency to clean frequency) of print head(s) of reference printer(s), and the vertical axis represents the cumulative motor count upon a failure occurrence of the print head(s) of the reference printer(s). As seen from experiment data in this figure, in all cleaning behavior, the larger the proportion of the wipes is, the more damage the print head suffers, and the more liable to failures the print head is.

Figure 3D:
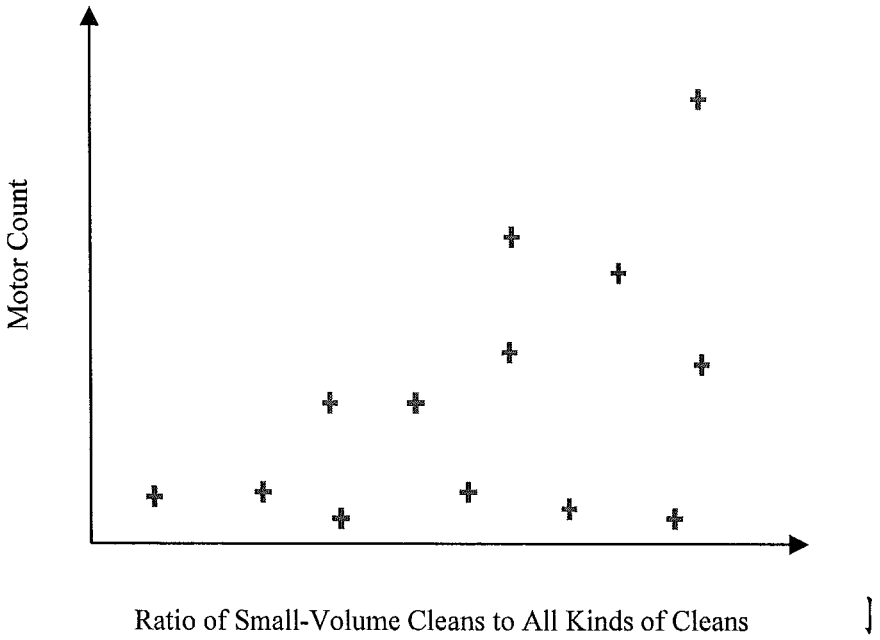
FIG. 3D shows a schematic view of a relationship between a proportion of small-volume flushing and motor count according to one embodiment of the present invention.

FIG. 3D shows a schematic view of a relationship between a proportion of small-volume flushing and the motor count according to one embodiment of the present invention. The horizontal axis represents the ratio of the small-volume flushing of print head(s) of reference printer(s), and the vertical axis represents the cumulative motor count upon a failure occurrence of the print head(s) of the reference printer(s). As seen from experiment data in this figure, among all kinds of cleaning behavior, the smaller the proportion of the small-volume flushing (or the larger the proportion of large-volume flushing) is, the more damage the print head suffers, and the more liable to failures the print head is. This is mainly because that large-volume cleaning behavior causes more serious damage to the print head than small-volume cleaning behavior.

Figure 3E:
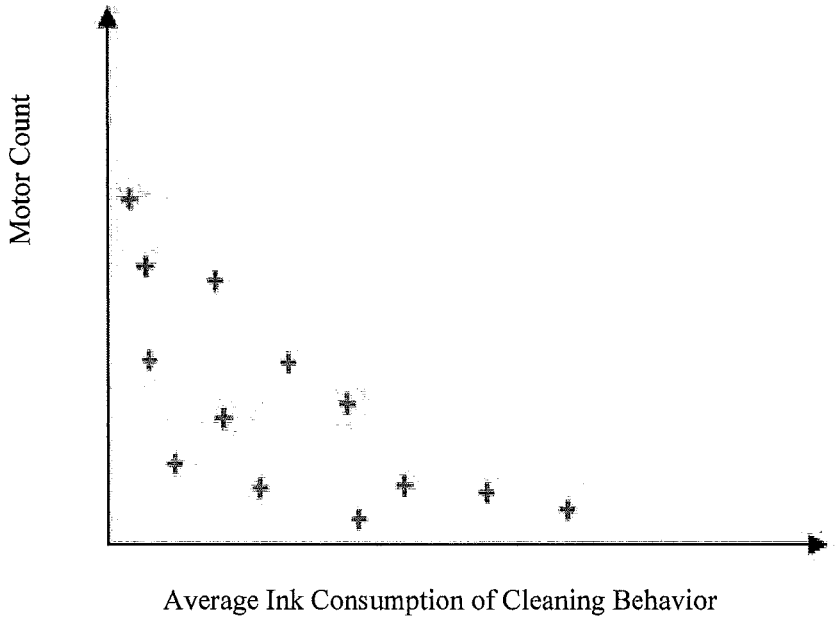
FIG. 3E shows a schematic view of a relationship between average ink consumption and motor count according to one embodiment of the present invention.

FIG. 3E shows a schematic view of a relationship between an average ink consumption and the motor count according to one embodiment of the present invention. The horizontal axis represents the average ink consumption of print head(s) of reference printer(s) (i.e., ink consumption for unit printing amount, e.g., cleaning behavior's ink consumption every time a piece of paper is printed), and the vertical axis represents the cumulative motor count upon a failure occurrence of the print head(s) of the reference printer(s). As seen from experiment data in this figure, the higher the average ink consumption of cleaning behavior is, the more damage the print head suffers, and the more liable to failures the print head, of which the principle is similar to that in FIG. 3D. This is mainly because that large-volume cleaning behavior causes more serious damage to the print head than small-volume cleaning behavior.

With reference to FIG. 2, detailed illustration is presented to each step in this figure. In step A, it is obtained of cleaning behavior data and a cumulative printing amount upon a failure occurrence of print head(s) of reference printer(s), as well as cleaning behavior data of a print head of a current printer. In order to determine a survival state of the print head of the current printer, it is necessary to use some information of the print head(s) of the reference printer(s). The print head(s) of the reference printer(s) is a print head where failures have occurred. Failures of the print head(s) of the reference printer(s) disable the print head(s) of the reference printer(s) from working, that is, the lifecycle of the print head ends. Therefore, if printer clogging can be recovered by cleaning, then this is not included in the range of failures.

The present invention is not intended to limit a number of print heads of the reference printer. However, it should be understood that the more print head data of the reference printer, the more helpful for the accuracy of determined survival state of the print head of the current printer. In an example experimented by the inventors of the present invention, the number of print heads of the reference printer is 13 (FIGS. 3A to 3E record cumulative motor counts upon failure occurrence in 13 print heads of the reference printer).

Optionally, a model of the print head(s) of the reference printer(s) is the same as a model of the print head of the current printer. It should be understood that using a reference printer in the same model helps to increase the accuracy of determined survival state of the print head of the current printer. Optionally, an environment where the reference printer is located is the same as an environment where the current printer is located. The environment sameness includes at least one of: the same geographical locations (e.g., in the same city, the same community, the same building, etc.), approximately the same temperature, approximately the same humidity, approximately the same dust density, serving in the same industry (e.g., serving in the advertising industry, print media, etc.).

Optionally, the cleaning behavior data includes at least one of the following items: a clean frequency of the print head, a wipe frequency of the print head, a ratio of a number of wipes to that of cleans of the print head, a ratio of small-volume cleans to all kinds of cleans of the print head, and an average ink consumption of cleaning behavior of the print head. Each of the above items is related to cleaning behavior. The clean frequency of the print head may be represented as the number of cleans within unit printing amount (i.e., total cleans divided by a printing amount). The wipe frequency of the print head may be represented as the number of wipes within unit printing amount (i.e., total wipes divided by a printing amount). The small-volume cleaning of the print head represents cleans whose ink consumption is less than a given value, among all kinds of cleans of the print head (cleaning causes ink consumption, especially ink consumption of large-volume cleaning is quite considerable). For example, a printer itself has two volume cleaning modes, one of which is represented as CL1 and the other of which is represented as CL2, wherein CL2 consumes more ink than CL1, so CL1 is small-volume cleaning and CL2 is large-volume cleaning. The average ink consumption of cleaning behavior of the print head may be represented as ink consumption of cleaning behavior within unit printing amount. In the prior art ink consumption of cleaning behavior of a printer can be detected separately. Therefore, dividing detected total ink consumption of cleaning behavior by printing amount results in the average ink consumption of cleaning behavior of the print head. It should be understood that the more items contained in the cleaning behavior data, the more accurate measured survival state of the print head.

The cleaning behavior data of the print head(s) of the reference printer(s) may be cumulative cleaning behavior of the print head(s) of the reference printer(s) at a certain moment, during a certain period pervious to failure occurrence, in all time before failure occurrence, or upon failure occurrence. The cleaning behavior data of the print head of the current printer includes cleaning behavior of the current printer at a certain moment, during a certain period, or in all time before the measurement, etc. . . .

Optionally, the printing amount includes at least one of: the number of printing sheets, a printing motor count, hours of service, a printing-related ink consumption, and a printing area. Hours of service may include at least one of: a duration for executing print jobs, a duration of power-on state, a total duration from the first job (might include the duration of power-on state), etc. The printing ink consumption may include at least one of: an ink consumption for executing print jobs, a total ink consumption (including an ink consumption for print jobs and an ink consumption for cleans), etc. The motor count is a count of motor for marking a movement amount of the print head, which represents total movement amount of the print head within the lifecycle; this data item can reflect the workload of the print head more accurately than other printing amount data.

Optionally, the three data items obtained in step A (the cleaning behavior data and the cumulative printing amount upon failure occurrence of the print head(s) of the reference printer(s), as well as the cleaning behavior data of the print head of the current printer) may be obtained offline; that is, these data may be obtained in advance before determining survival state of the print head of the current printer other than being obtained in real time. This is because these three data items, especially the first two data items (i.e., the cleaning behavior data and the cumulative printing amount upon failure occurrence of the print head(s) of the reference printer(s)) may be fixed. With respect to the third data item (i.e., the cleaning behavior data of the print head of the current printer), where the printer's usage mode is substantially fixed, it also substantively does not change greatly.

Optionally, these three data items obtained in step A may be obtained remotely or locally. If the method is applied to the server end, then the server needs to remotely obtain these data about the reference printer and the current printer. On the contrary, if the method is applied to the current printer end, then the first two data items (the cleaning behavior data and the cumulative printing amount upon failure occurrence of the print head(s) of the reference printer(s)) might be obtained remotely (e.g., from the server), while the last data item needs to be obtained locally. Of course, the first two data items may be put in advance in the current printer's application, so that they do not have to be obtained from a remote server. Therefore, the present invention does not limit the applicable subject (a printer or a server) of the method, so the present invention is also not intended to limit the data obtaining approach.

In step B, a printing amount of the current printer is obtained. Optionally, the printing amount of the current printer may be current printing amount or printing amount specified by any user. Optionally, the printing amount of the current printer in step B may be obtained remotely or locally. When step B is executed on the current printer, the current printer may locally obtain the printing amount of the current printer. When step B is executed on a server, the server may obtain the printing amount from the remote current printer.

Optionally, if the user wants to learn survival state of the current printer in real time, step B may be implemented in real time.

In step C, a survival state of the print head of the current printer is determined according to the cleaning behavior data and the cumulative printing amount upon failure occurrence of the print head(s) of the reference printer(s), as well as the cleaning behavior data and the printing amount of the current printer.

In one embodiment of the present invention, the step C further includes steps C1 and C2 (not shown in the figure).

Figures 4, 5:
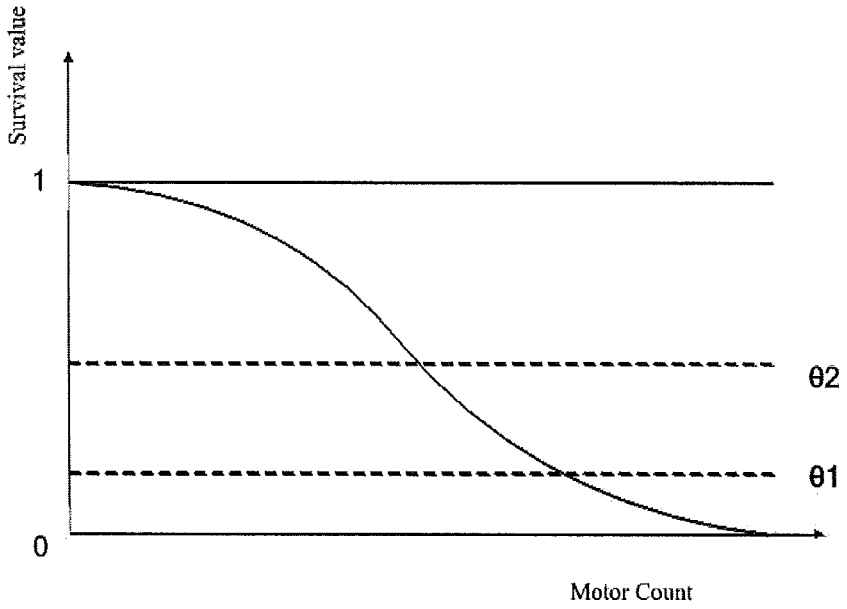
FIG. 4 shows a schematic view of a relationship between motor count and survival value according to one embodiment of the present invention.
FIG. 5 shows a schematic view of demand for print head reserves.

In step C1, a survival function of the print head of the current printer is established according to the cleaning behavior data and the cumulative printing amount upon failure occurrence of the print head(s) of the reference printer(s) as well as the cleaning behavior data of the current printer. By using an existing survival analysis model (such as Proportional Hazards Model or Cox Model, and Proportional Odds Model, etc.), once the known cleaning behavior data and the cumulative printing amount upon failure occurrence of the print head(s) of the reference printer(s) as well as the cleaning behavior data of the current printer are inputted, a survival function can be obtained. The survival function's graphical representation is as shown in FIG. 4, wherein the horizontal axis is the printing amount, specifically the motor count, and the vertical axis is the survival value. Optionally, the survival value may be a numeric normalized between 0 and 1. The survival function shown in FIG. 4 is used for measuring the relationship between the current printer's printing amount and the survival value. Apparently, the larger the printing amount, the lower the survival value, and the less the remaining lifetime. Since the cleaning behavior of the print head of the current printer is taken into consideration when calculating the survival function thereof, each printer can obtain a personalized survival function according to its own cleaning behavior, so that the correspondence relationship between each printer's printing amount and print head survival value. Since the survival analysis model belongs to the prior art, the present disclosure does not go into details of the process of solving the survival analysis model.

In step C2, a survival state under printing amount of the current printer is determined according to the survival function. Optionally, the survival state may be represented as at least one of: a survival value (for the calculation of survival value, a more detailed introduction will be presented below), and a remaining printing amount. Obviously, as long as the survival function is determined, the survival state (e.g., survival value) can be determined from the printing amount (e.g., current printing amount).

Further, the impact of environmental information on survival state of the print head may further be considered in determining the survival state, wherein the environmental information includes at least one of: temperature, humidity, and dust density. Generally speaking, the higher the temperature, the more liable to be damaged the print head; the lower the humidity, the more liable to be damaged the print head; the higher dust density within unit space, the more liable to be damaged for the print head. Therefore, the accuracy of a measurement result will be further increased by taking the environmental information into consideration of the process of determining survival state of the print head.

Specifically, step A further comprises: obtaining environmental information of the print head(s) of the reference printer(s) and environmental information of the print head of the current printer. The environmental information of the print head(s) of the reference printer(s) may be one of: average environmental information (e.g., average humidity) of the print head(s) of the reference printer(s) upon failure occurrence, cumulative environmental information (e.g., humidity upon failure occurrence) of the print head(s) of the reference printer(s) upon failure occurrence, environmental information (e.g., humidity upon failure occurrence) of the print head(s) of the reference printer(s) at a certain moment upon failure occurrence, etc. The environmental information of the print head of the current printer may be one of: average environmental information (e.g., average temperature) of the print head of the current printer, environmental information of the print head of the current printer at a certain moment (e.g., upon measurement), etc.

Step C comprises: determining a survival state of the print head of the current printer according to the cleaning behavior data, the environmental information and the cumulative printing amount upon failure occurrence of the print head(s) of the reference printer(s) as well as the cleaning behavior data, the environmental information and the printing amount of the current printer. If the above embodiment regarding a survival function is applied, then step C further comprises C1' and C2', wherein in step C1' a survival function of the print head of the current printer is established according to the cleaning behavior data, the cumulative printing amount and the environmental information upon failure occurrence of the print head(s) of the reference printer(s) as well as the cleaning behavior data and the environmental information of the current printer (i.e., inputs regarding environmental information of the reference printer and the current printer are added while applying a survival analysis model). In step C2' survival state under the printing amount of the current printer is determined according to the survival function.

In another embodiment, the present invention may leverage a more straightforward approach to determining survival state of the print head of the current printer, e.g., looking for a print head that is the same as the cleaning behavior data (or cleaning behavior data and environmental information) of the print head of the current printer (hereinafter referred to as a selected print head of the reference printer) among print heads of the reference printer, and determining the survival state of the print head of the current printer according to the cumulative printing amount upon failure occurrence of the selected print head of the reference printer. For example, the printing amount upon failure occurrence of the selected print head of the reference printer is 10000 sheets, and the printing amount of the print head of the current printer is 5000 sheets, then it may be decided that the remaining printing amount of the current printer is 5000 sheets.

It should be understood that in FIG. 2 step A is displayed before step B. However, the present invention is not intended to limit an order between the two steps; in other embodiment, step A and step B may be executed concurrently or step A is executed after step B.

Optionally, the method in FIG. 2 may further comprise: in step D sending a notification of replacing the print head according to whether the survival state exceeds a survival state threshold. Further, the notification of replacing the print head further includes at least one of: a notification of suggesting reserving new print heads, and a notification of suggesting replacing with a new print head. Still illustration is presented by taking the schematic view in FIG. 4 as an example. θ1 and θ2 are two respective survival state thresholds. When a survival value of the print head of the current printer reaches θ2, then the notification of suggesting starting to reserve new print heads (because it might take a long time to reserve and transport print heads) is sent. When a survival value of the print head of the current printer reaches θ1, then the notification of suggesting replacing with a new print head is sent; in this case, the survival state of the print head might deteriorate to a serious extent, the printing efficiency will be prejudiced if the print head is not replaced.

Optionally, the survival state threshold (e.g., θ1 and θ2) may be fixed, e.g., determined according to empirical values, so that the same survival state threshold may be selected for different print heads.

Optionally, the survival state threshold (e.g., θ1 and θ2) may also be dynamically determined according to a curvature radius extremum of the survival function, so that different survival state thresholds may be set for different print heads. For example, in FIG. 4 a curvature radius of the survival function is the largest at the threshold θ1 and the smallest at the threshold θ2.

According to one embodiment of the present invention, there is further provided a method for determining reserve demand, comprising: determining a demand for print head reserves according to at least one survival state determined by the method for determining survival state of a print head. FIG. 5 shows a schematic view of determining demand for print head reserves. The first column "Equipment ID" represents an identifier of each print head, and the second column "Print Head" represents a survival value of each print head. Optionally, a state of each print head may be identified in color; for example, green represents there is no need to replace the print head, yellow represents it is possible to start to reserve a current print head, and red represents it is necessary to replace the print head.

Although in this embodiment the demand for print head reserves is represented using colors, values and graphs, the present invention is not intended to limit forms of the demand for reserves, but any one of more of colors, values, graphs and characters may be used. In one example, the demand for print head reserves may be used for displaying survival state of all print heads within a maintenance service area of a given print head, so as to determine how many print heads should be reserved for the maintenance service area. In another example, the demand for print head reserves may be demand for print head reserves of one or more printers used by a printer user, so that new print heads may be purchased in advance so as to ensure unremitting work of his/her printer(s).

Figure 6:
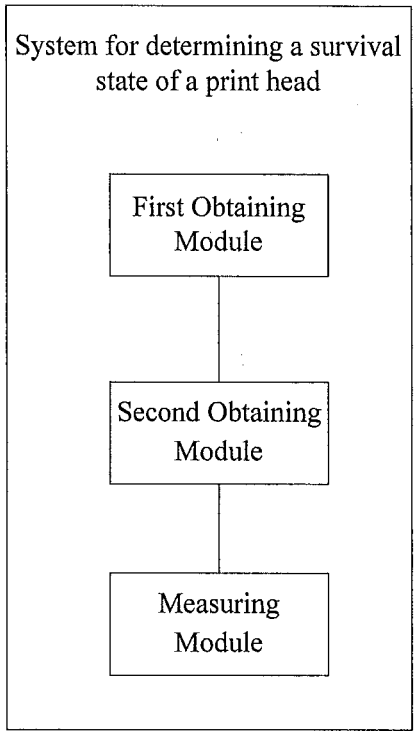
FIG. 6 shows a block diagram of a system for determining survival state of a print head.

Various embodiments implementing the method of the present invention have been described above with reference to the accompanying drawings. Those skilled in the art may understand that the method may be implemented in software, hardware or a combination of software and hardware. Moreover, those skilled in the art may understand by implementing steps in the above method in software, hardware or a combination of software and hardware, there may be provided an apparatus based on the same invention concept. Even if the apparatus has the same hardware structure as a general-purpose processing device, the functionality of software contained therein makes the apparatus manifest distinguishing properties from the general-purpose processing device, thereby forming an apparatus of the various embodiments of the present invention. The apparatus described in the present invention comprises several means or modules, the means or modules configured to execute corresponding steps. Upon reading this specification, those skilled in the art may understand how to write a program for implementing actions performed by these means or modules. With reference to FIG. 6, detailed description is presented below to a system for determining survival state of a print head according to various embodiments of the present invention. Since the system is based on the same invention concept as the method, the same or corresponding implementation details are also applicable to means or modules corresponding to the method. As detailed and complete description has been presented above, this specification will not go into unnecessary details below.

FIG. 6 shows a block diagram of a system for determining survival state of a print head. The system comprises first obtaining means, second obtaining means and determining means. The first obtaining means is configured to obtain cleaning behavior data and cumulative printing amount upon failure occurrence of print head(s) of reference printer(s) as well as cleaning behavior of a print head of a current printer.

It may be understood the first obtaining means may further comprise three sub-means for obtaining the above three data items, e.g., first obtaining sub-means is for obtaining cleaning behavior data of the print head(s) of the reference printer(s), second obtaining sub-means is for obtaining cumulative printing amount upon failure occurrence of the print head(s) of the reference printer(s), and third obtaining sub-means is for obtaining cleaning behavior of the print head of the current printer. The second obtaining means is configured to obtain printing amount of the current printer. The determining means is configured to determine survival state of the print head of the current printer according to cleaning behavior data and cumulative printing amount upon failure occurrence of the print head(s) of the reference printer(s) as well as cleaning behavior and printing amount of the current printer.

According to one embodiment of the present invention, the determining means further comprises: building sub-means and determining sub-means. The building sub-means is configured to build a survival function of the print head of the current printer according to cleaning behavior data and cumulative printing amount upon failure occurrence of the print head(s) of the reference printer(s) as well as cleaning behavior of the current printer. The determining sub-means is configured to determine survival state under printing amount of the current printer according to the survival function.

According to one embodiment of the present invention, the system further comprises notifying means. The notifying means is configured to send a notification of replacing a print head according to whether the survival state exceeds a survival state threshold.

According to one embodiment of the present invention, the notification of replacing a print head further comprises at least one of: a notification of suggesting reserving new print heads, and a notification of suggesting using a new print head.

According to one embodiment of the present invention, the cleaning behavior data comprises at least one of: clean frequency of print head, wipe frequency of print head, ratio of wipes to cleans of print head, proportion of small-volume cleans to all kinds of cleans of print head, and average ink consumption of cleaning behavior of print head.

According to one embodiment of the present invention, the printing amount comprises at least one of: printing sheets, printing motor count, hours of service, printing-related ink consumption, and printing area.

According to one embodiment of the present invention, the first obtaining means is further configured to: obtain environmental information of the print head(s) of the reference printer(s), and environmental information of the print head of the current printer. For example, fourth obtaining sub-means in the first obtaining means obtains environmental information of the print head(s) of the reference printer(s), and fifth obtaining sub-means in the first obtaining means obtains environmental information of the print head of the current printer. The determining means is configured to: determine survival state of the print head of the current printer according to cleaning behavior data and cumulative printing amount upon failure occurrence and environmental information of the print head(s) of the reference printer(s) as well as cleaning behavior data, printing amount and environmental information of the current printer.

According to one embodiment of the present invention, the environmental information comprises at least one of: temperature, humidity and dust density.

According to one embodiment of the present invention, the survival state may be represented as at least one of: a survival value and remaining printing amount.

Further, the present disclosure provides a system for determining demand for print head reserves, which is configured to determine demand for print head reserves according to at least one survival state determined by the system for determining survival state of a print head.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A system for determining a survival state of a print head, comprising:

a first obtaining module configured to obtain cleaning behavior data and a cumulative printing amount upon failure occurrence of print head(s) of reference printer(s) as well as cleaning behavior data of a print head of a current printer;

a second obtaining module configured to obtain a printing amount of the current printer; and a determining module configured to determine the survival state of the print head of the current printer according to cleaning behavior data and the cumulative printing amount upon failure occurrence of the print head(s) of the reference printer(s), as well as the cleaning behavior data and the printing amount of the current printer.

2. The system according to claim 1, wherein the determining module further comprises:

a building sub-module configured to build a survival function of the print head of the current printer according to the cleaning behavior data and the cumulative printing amount upon failure occurrence of the print head(s) of the reference printer(s), as well as the cleaning behavior data of the current printer;

a determining sub-module configured to determine the survival state under the printing amount of the current printer according to the survival function.

3. The system according to claim 1, further comprising:

a notifying module configured to send a notification that a print head needs to be replaced according to whether the survival state exceeds a survival state threshold.

4. The system according to claim 3, wherein the notification that a print head needs to be replaced further comprises at least one of: a notification of suggesting starting to reserve new print heads, and a notification of suggesting replacing a new print head.

5. The system according to claim 1, wherein the cleaning behavior data comprises at least one of: a clean frequency of the print head, a wipe frequency of the print head, a ratio of the number of wipes to that of cleans of the print head, a proportion of small-volume cleans to all kinds of cleans of the print head, and an average ink consumption of cleaning behavior of the print head.

6. The system according to claim 1, wherein the printing amount comprises at least one of: the number of printing sheets, a printing motor count, hours of service, a printing-related ink consumption, and a printing area.

7. The system according to claim 1, wherein the first obtaining module is further configured to: obtain environmental information of the print head(s) of the reference printer(s), and environmental information of the print head of the current printer;

the determining module is further configured to: determine the survival state of the print head of the current printer according to the cleaning behavior data and the cumulative printing amount upon failure occurrence and the environmental information of the print head(s) of the reference printer(s) as well as the cleaning behavior data, the environmental information and the printing amount of the current printer.

8. The system according to claim 7, wherein the environmental information comprises at least one of: temperature, humidity and dust density.

9. The system according to claim 1, wherein the survival state is represented as at least one of: a survival value and a remaining printing amount.

10. A system for determining demand for reserves configured to:

determine a demand for print head reserves according to at least one survival state determined according to claim 1.

* * * * *